US005566797A

United States Patent [19]

Van Himbeeck

[11] Patent Number: 5,566,797

[45] Date of Patent: Oct. 22, 1996

[54] INTEGRATED FLIGHT BAG AND GARMENT BAG LAGGAGE CASE

[75] Inventor: Clemens Van Himbeeck, Maarkedal, Belgium

[73] Assignee: Samsonite Corporation, Denver, Colo.

[21] Appl. No.: 213,333

[22] Filed: Mar. 14, 1994

[51] Int. Cl.[6] ..... A45C 5/12; A45C 5/14; A45C 7/00; A45C 13/26

[52] U.S. Cl. ..... 190/18 A; 190/39; 190/107; 190/109; 190/102; 190/108; 190/115; 206/279; 206/287; 206/289; 206/292

[58] Field of Search ..... 190/102, 107, 190/108, 109, 115, 903, 901, 39, 18 A; 383/23; 206/287.1, 287, 289, 279, 278, 292

[56] References Cited

U.S. PATENT DOCUMENTS

| | | | |
|---|---|---|---|
| D. 300,689 | 4/1989 | King et al. | D3/71 |
| 504,840 | 9/1893 | Krick | 190/108 |
| 1,150,057 | 8/1915 | O'Neill | 190/109 |
| 1,292,493 | 1/1919 | Logan | 206/279 |
| 1,562,417 | 11/1925 | Schuck | 206/289 X |
| 1,638,837 | 8/1927 | Deitsch . | |
| 1,796,961 | 3/1931 | Ritter, Jr. | 206/292 |
| 1,823,403 | 9/1931 | Krueger | 206/289 X |
| 1,844,336 | 2/1932 | Ritter, Jr. | 206/289 |
| 1,960,455 | 5/1934 | Ritter, Jr. | 206/289 |
| 1,975,294 | 10/1934 | Sand et al. | 206/289 |
| 2,086,895 | 7/1937 | Cart | 206/287.1 X |
| 2,109,141 | 2/1938 | Richter . | |
| 2,157,833 | 5/1939 | Plotkin . | |
| 2,362,807 | 11/1944 | Dresner | 190/110 X |
| 2,423,297 | 7/1947 | Creamer | 206/287.1 |
| 2,635,721 | 4/1953 | Suben | 190/109 X |
| 2,740,506 | 4/1956 | Davis | 206/287.1 |
| 2,774,450 | 12/1956 | Smallberg | 206/287.1 X |
| 2,797,779 | 7/1957 | Davis | 206/287.1 X |
| 2,839,167 | 6/1958 | Thorlough | 206/287.1 X |

(List continued on next page.)

FOREIGN PATENT DOCUMENTS

| | | | |
|---|---|---|---|
| 117830 | 11/1943 | Australia | 190/119 |
| 629153 | 10/1961 | Canada | 190/115 |
| 2680647 | 3/1993 | France | 190/18 A |
| 2680647A1 | 3/1993 | France | 190/18 A |
| 804347 | 4/1951 | Germany . | |
| 3602216 | 2/1987 | Germany | 190/109 |
| 490814 | 2/1954 | Italy | 190/107 |
| 664476A | 3/1988 | Liechtenstein . | |
| 627282 | 8/1949 | United Kingdom | 190/111 |
| 844390 | 8/1960 | United Kingdom . | |
| 867533 | 5/1961 | United Kingdom . | |
| 2186186 | 8/1987 | United Kingdom | 190/119 |
| WO93/19636 | 10/1993 | WIPO . | |

OTHER PUBLICATIONS

Advertisement in Hemisphere magazine for Travelpro Rollaboard Suit Carrier, Mar. 1994.

*Primary Examiner*—Sue A. Weaver
*Attorney, Agent, or Firm*—Lee R. Osman; Gregory W. O'Connor; Rod D. Baker

[57] ABSTRACT

A luggage case has a generally rectangular prismatic configuration of a size and shape similar to a flight bag when in the closed position, and presents a garment bag when in the expanded or open position. The luggage case comprises a support structure and a flexible panel connected to the support structure which extends laterally from the support structure to expose the interior of both the panel and the support structure. A selective attachment device connects the panel to the support structure to close the luggage case, forming the prismatic configuration. A support piece is connected to the interior of the panel to hold packed articles in the appropriate position. A packing pouch is connected to the support structure to extend from the interior of the case opposite of the panel when the case is opened. The packing pouch folds into the interior of the case and overlaps the packed articles when the case is in the closed position. The luggage case includes wheels and a guide handle that allow the case to be maneuvered and transported easily. An auxiliary luggage case attachment mechanism is provided to support an auxiliary luggage case on the closed luggage case so that the user can carry more than one case concurrently.

30 Claims, 10 Drawing Sheets

U.S. PATENT DOCUMENTS

| | | | |
|---|---|---|---|
| 3,104,740 | 9/1963 | Koffler | 190/115 |
| 3,164,231 | 1/1965 | Kryznoski | 206/292 |
| 3,175,658 | 3/1965 | Bierman . | |
| 3,273,678 | 9/1966 | Koret | 206/287 X |
| 3,291,266 | 12/1966 | Komroff | 190/113 X |
| 3,437,181 | 4/1969 | Blount, Jr. | 206/287.1 X |
| 3,453,663 | 11/1948 | Hinson | 190/100 |
| 3,729,038 | 4/1973 | Ekeson | 190/110 X |
| 3,777,862 | 12/1973 | Zipper | 190/107 |
| 3,869,034 | 3/1975 | Thornton, Jr. | 190/111 X |
| 3,933,229 | 1/1976 | Pelavin | 206/287.1 |
| 3,944,032 | 3/1976 | Samhammer et al. | 206/287.1 X |
| 3,967,708 | 7/1976 | Gregg et al. . | |
| 3,994,372 | 11/1976 | Geller et al. | 190/107 |
| 4,170,282 | 10/1979 | Schwartzstein | 190/108 X |
| 4,206,835 | 6/1980 | Shapiro | 190/108 |
| 4,244,453 | 1/1981 | Herz | 190/108 X |
| 4,436,189 | 3/1984 | Baum | 190/108 |
| 4,489,829 | 12/1984 | Myers et al. | 206/287 |
| 4,538,709 | 9/1985 | Williams et al. | 190/18 A |
| 4,598,803 | 7/1986 | Ghiassai | 190/108 |
| 4,613,039 | 9/1986 | Shaw et al. | 206/287.1 |
| 4,655,343 | 4/1987 | Lane et al. | 206/287.1 X |
| 4,693,368 | 9/1987 | King et al. | 206/287.1 |
| 4,887,700 | 12/1989 | Rice | 206/287.1 X |
| 4,887,751 | 12/1989 | Lehman | 190/903 X |
| 4,925,021 | 5/1990 | Pulichino, Jr. | 190/903 X |
| 4,927,014 | 5/1990 | Pulichino, Jr. | 206/287.1 |
| 4,995,487 | 2/1991 | Plath | 190/18 A |
| 4,998,603 | 3/1991 | Nordstrom | 190/18 A |
| 5,060,795 | 10/1991 | Bomes et al. | 206/279 |
| 5,105,920 | 4/1992 | Grebenstein | 190/903 X |
| 5,117,974 | 6/1992 | Bieber | 206/287.1 X |
| 5,253,739 | 10/1993 | King | 190/18 A |
| 5,394,964 | 3/1995 | White | 206/287.1 X |

INTEGRATED FLIGHT BAG AND GARMENT BAG LAGGAGE CASE

This invention relates to luggage, and more particularly to a new and improved configuration and integration of a garment bag as a flight bag style luggage case, preferably with wheels and a guide handle.

BACKGROUND OF THE INVENTION

One type of luggage which is currently very popular with air travelers is generally referred to as a flight bag. A flight bag is a moderate to small sized carry-on bag having a generally rectangular prismatic configuration and a size which allows it to be inserted in the space below an aircraft seat or in an overhead aircraft compartment. Also contributing to the popularity of flight bag style luggage cases is the use of wheels and a guide handle to allow the traveler to maneuver the case on its wheels rather than carry the luggage case by hand. One pair of wheels is positioned along a bottom edge of the luggage case. The guide handle is extendable from the luggage case and is used to lever the case onto the wheels and to pull the case. The wheel and guide handle configuration provides good stability, maneuverability and control of the case.

A flight bag style luggage case allows the user to obtain the important conveniences of a carry-on bag, thereby avoiding the delay and inconvenience of checking the luggage and the risk of loss of the luggage. By incorporating wheels on the flight bag style luggage case, the user obtains the important conveniences of easy transportation by rolling the case on its wheels, thereby avoiding the more strenuous effort of carrying the luggage case by hand. U.S. Pat. No. 5,253,739, assigned to the assignee of the present application, discloses an example of a "carry-on" flight bag style luggage case with wheels and a guide handle which obtains these important advantages.

Another popular type of luggage is a garment bag. A garment bag allows articles of clothing such as shirts, blouses, jackets, suitcoats, trousers, dresses, skirts and coats to be quickly packed in the bag on hangers. After the clothing is hung on hangers in the garment bag, the garment bag is closed and folded in half to reduce its size and make it easier to carry. The clothing is confined in the garment bag in a manner which minimizes wrinkling. At the traveler's destination, the garment bag is unfolded, suspended from a closet bar or door, and the clothes are thereafter taken directly from the garment bag for use and replaced in the garment bag after use. The garment bag can thereby be kept in a state of readiness without having to pack and unpack it at each destination. A further benefit of a garment bag is that it is carry-on luggage which may be conveniently placed in an aircraft overhead compartment or hung in a closet within the aircraft after the bag is unfolded. An example of a garment bag is found in U.S. Pat. No. 4,738,360, also assigned to the assignee of the present invention.

In the past, attempts have been made to obtain the conveniences of wheeled transportation by incorporating wheels with traditional garment bags. These attempts have generally involved attaching a relatively cumbersome and heavy structure to the outside of the garment bag. Some of these structures have incorporated extendable supports which require the garment bag to be unfolded and connected to the extendable supports before the bag can be moved on its wheels. Unfortunately, the addition of the relatively rigid support structure and the wheels have increased the weight of the garment bag to the point where it was burdensome to carry and to use. The relatively rigid support structure and wheels have decreased the flexibility of the garment bags to the point where their value as carry-on luggage was greatly diminished, by reason of the fact that it was considerably more difficult to fit the rigid structure and the bag in the overhead compartment or in closets.

Another very popular convenience for travelers using wheeled luggage is the capability of attaching a second auxiliary case to the primary luggage case. An extendable connector or attachment device such as a strap, belt or hook, supports the auxiliary luggage on an upturned face of the wheeled primary luggage case. The user can thereafter maneuver both luggage cases at the same time on the wheels of the primary case, by exerting very little additional force compared to that required to maneuver the primary case by itself on its wheels.

It is with respect to these considerations and others that the present improvements relative to flight bag and garment bag style luggage cases have evolved.

SUMMARY OF THE INVENTION

One of the important features of the present invention is to combine and integrate a flight bag and a garment bag in a single luggage case which obtains the desirable conveniences of carry-on luggage while retaining all of the desirable aspects of a garment bag and a flight bag without introducing any significant detriments to the individual advantages of each style of luggage bag by itself. Another important feature of the present invention is to obtain these improvements in a luggage case that incorporates wheels and a guide handle, so the integrated flight bag and garment bag luggage case can be conveniently rolled on the wheels and maneuvered by the guide handle. An additional important feature, among others, is to integrate into a luggage case offering the previously described improvements the capability of attaching auxiliary luggage to allow the auxiliary luggage to be carried during movement of the integrated flight bag and garment bag on its wheels.

In accordance with these and other features, one aspect of the present invention relates a luggage case having a generally rectangular prismatic configuration of a size and shape similar to a flight bag when in a closed position and presenting a garment bag configuration for packing clothes when the case is in an open position. The luggage case comprises a support structure for the case and a flexible exterior panel connected to the support structure. The panel extends from the support structure to expose an interior of the panel and the case, and the panel forms an exterior wall of the garment bag configuration. A selective attachment device connects the panel to the support structure to complete the prismatic configuration when the case is in the closed position. A support piece is connected to the interior of the panel at a position to overlap clothes extending along the panel packed in the garment bag configuration. The support piece holds the clothes against the panel and generally in the garment bag configuration peripherally around the interior of the case when in the closed position.

In accordance with these and other features, another aspect of the present invention relates a flight bag style luggage case which has a general rectangular prismatic shape in a closed position, formed by a top face, a bottom face, a right face, a left face, a front face and a back face. The top face opposes the bottom face and both the top and bottom faces extend in the length and width dimension of the prismatic shape. The right face and the left face oppose one another and extend in the height and length dimension of the prismatic shape. The front face and the back face oppose one another and extend in the height and width dimensions of the prismatic shape. The prismatic shape encloses an interior adapted for receiving garments and which is openable to an open position to expose the interior for packing the garments. the case comprises a panel and a support structure. The panel comprises the left face, the front face and the right face, all of which are flexibly attached together in the panel. The panel also forms part of an integral garment bag for receiving the garments. The support structure is connected to the top face, the back face and the bottom face, and rigidly holding the faces in a U-shape. A living hinge connects the left face and the back face and attaches the support structure to the panel. A selectively closeable fastener connects the panel and the support structure to form the prismatic shape and close the case.

In accordance with these and other features, another aspect of the present invention relates a luggage case having a generally rectangular prismatic configuration of a size and shape similar to a flight bag when in a closed position and presenting a garment bag configuration for packing clothes in a garment bag style when the case is in an open position. The case comprises a support structure to support the case, a flexible exterior panel connected to the support structure and extendable laterally away from the support structure to expose the interior of the panel and the support structure and to form an exterior wall of the garment bag configuration when the case is in the open position. A selective attachment device connects the panel to the support structure to complete the prismatic configuration when the case is in the closed position. A packing pouch having an interior into which to pack articles is flexibly connected an edge to the support structure to allow the packing pouch to fold away from the support structure when the case is in the open position and to allow the packing pouch to fold into the interior of the case and be surrounded by the clothes packed in the garment bag configuration when the bag is in the closed position.

In accordance with these and other features, a further aspect of the present invention relates a method of using a luggage case having a generally rectangular prismatic configuration of a size and shape similar to a flight bag when in a closed position and presenting a garment bag configuration for packing articles in a garment bag style when the case is in an open position. The method involves disconnecting a flexible panel at a first edge perimeter from a second corresponding edge perimeter of a rigid support structure to which the panel is permanently connected except at the first edge perimeter, extending the panel from the support structure to expose the garment bag configuration of which the panel is a part, folding a packing pouch out away from the support structure to which the packing pouch is connected to expose the garment bag configuration in which to pack articles, packing the articles in the garment bag configuration in a garment bag packing style by laying the articles adjacent to the support structure and the extended panel, packing articles in the packing pouch while the packing pouch is folded away from the support structure, folding the packing pouch with the article therein over the support structure and over an upper portion of the articles packed in the connected to expose the garment bag configuration, folding the panel and the articles packed in the garment bag configuration over and around the packing pouch, and connecting the panel edge perimeter and the support structure edge perimeter to enclose the articles within the luggage case.

More complete appreciation of the present invention and its scope can be obtained from understanding the accompanying drawings, which are briefly summarized below, the following detailed description of the presently preferred embodiment of the invention, and the appended claims.

DETAILED DESCRIPTION

Figure 1:
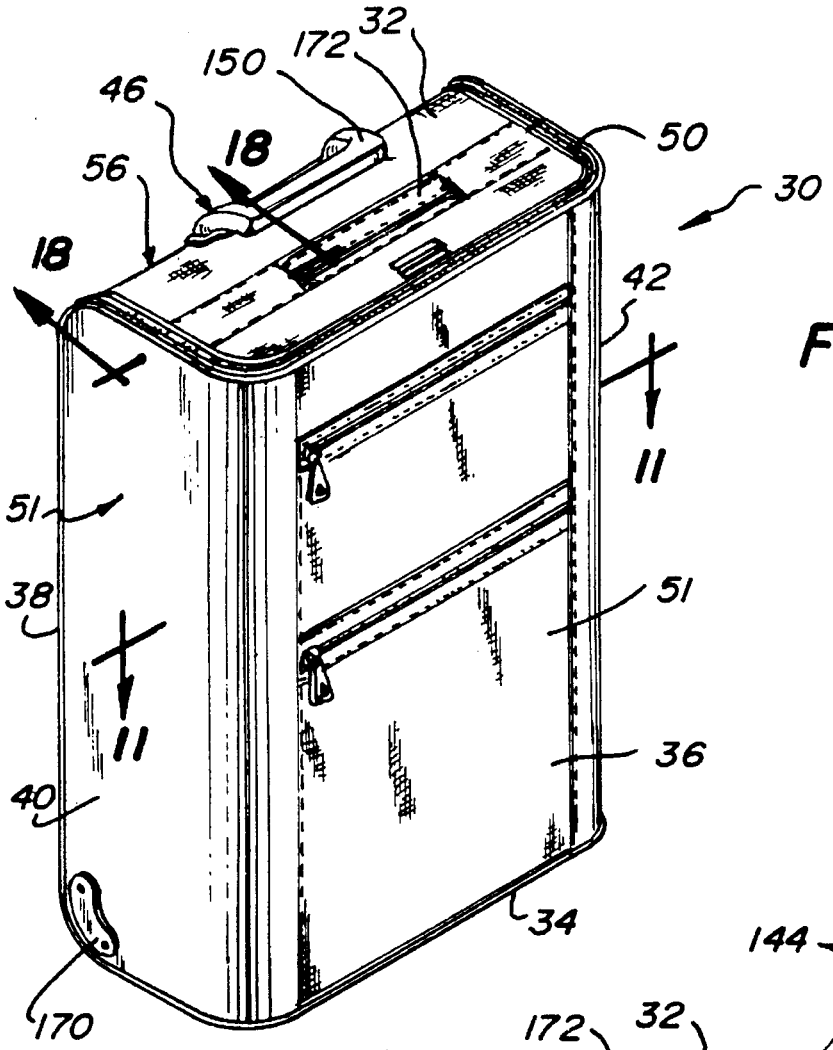
FIG. 1 is a front perspective view of a luggage case incorporating the present invention, shown in the closed position.
Figure 2:
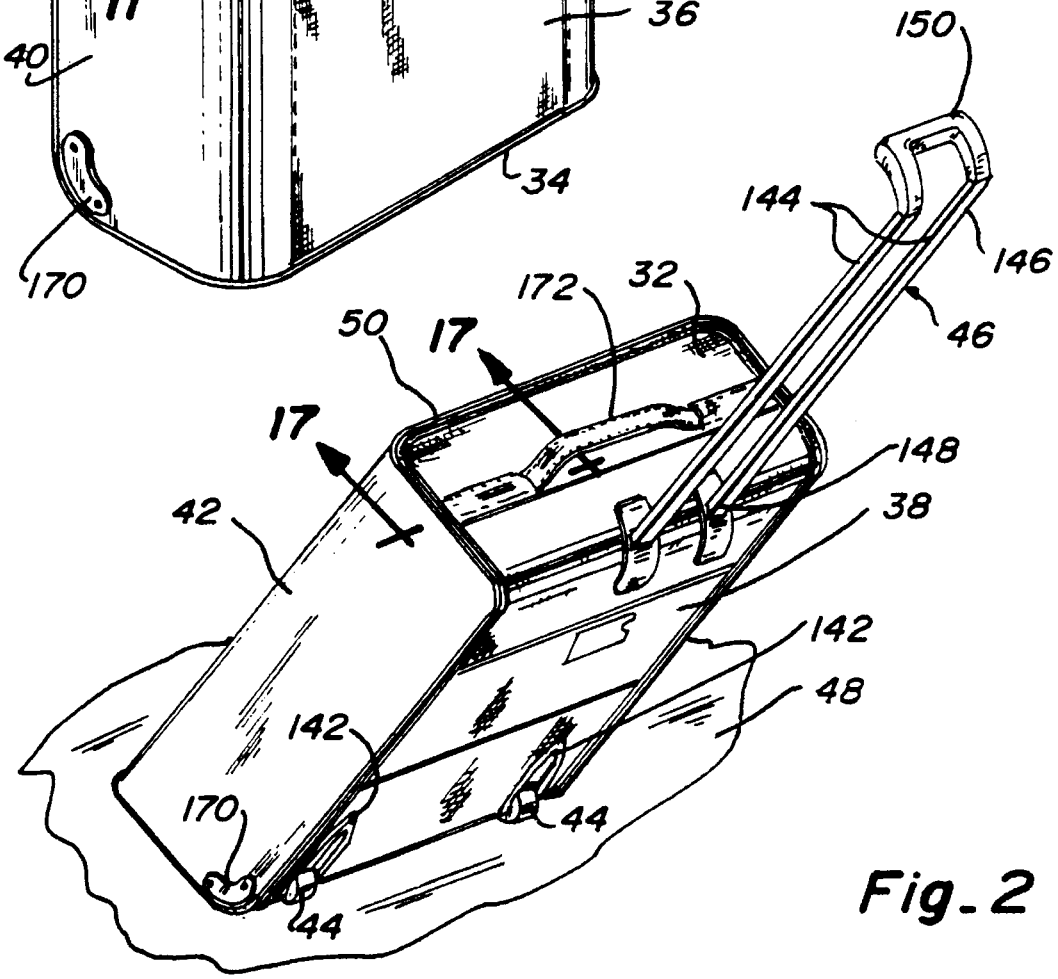
FIG. 2 is a rear perspective view of the luggage case shown in FIG. 1, with a guide handle extended from the luggage case to transport the case on a pair of wheels.

A luggage case 30, which embodies one form of the present invention, is shown in the closed position in FIGS. 1 and 2. The case 30 has a top face 32, a bottom face 34, a front face 36, a back face 38, a left face 40 and a right face 42, all of which are joined together to form a substantially rectangular prismatic configuration when the case 30 is in the closed position. A pair of wheels 44 are rotatably attached to the case 30 at the corner intersection of the back face 38 and the bottom face 34. A guide handle 46 is attached adjacent to the back face 313 and is selectively extendable by the user from the case 30, as is shown in FIG. 2. With the guide handle 46 extended, the user levers the case 30 onto the wheels 44, holds the case in this position with only the wheels 44 touching a floor or support surface 48, and then pulls the case 30 on the wheels 44 while maneuvering it with the guide handle 46.

Figure 3:
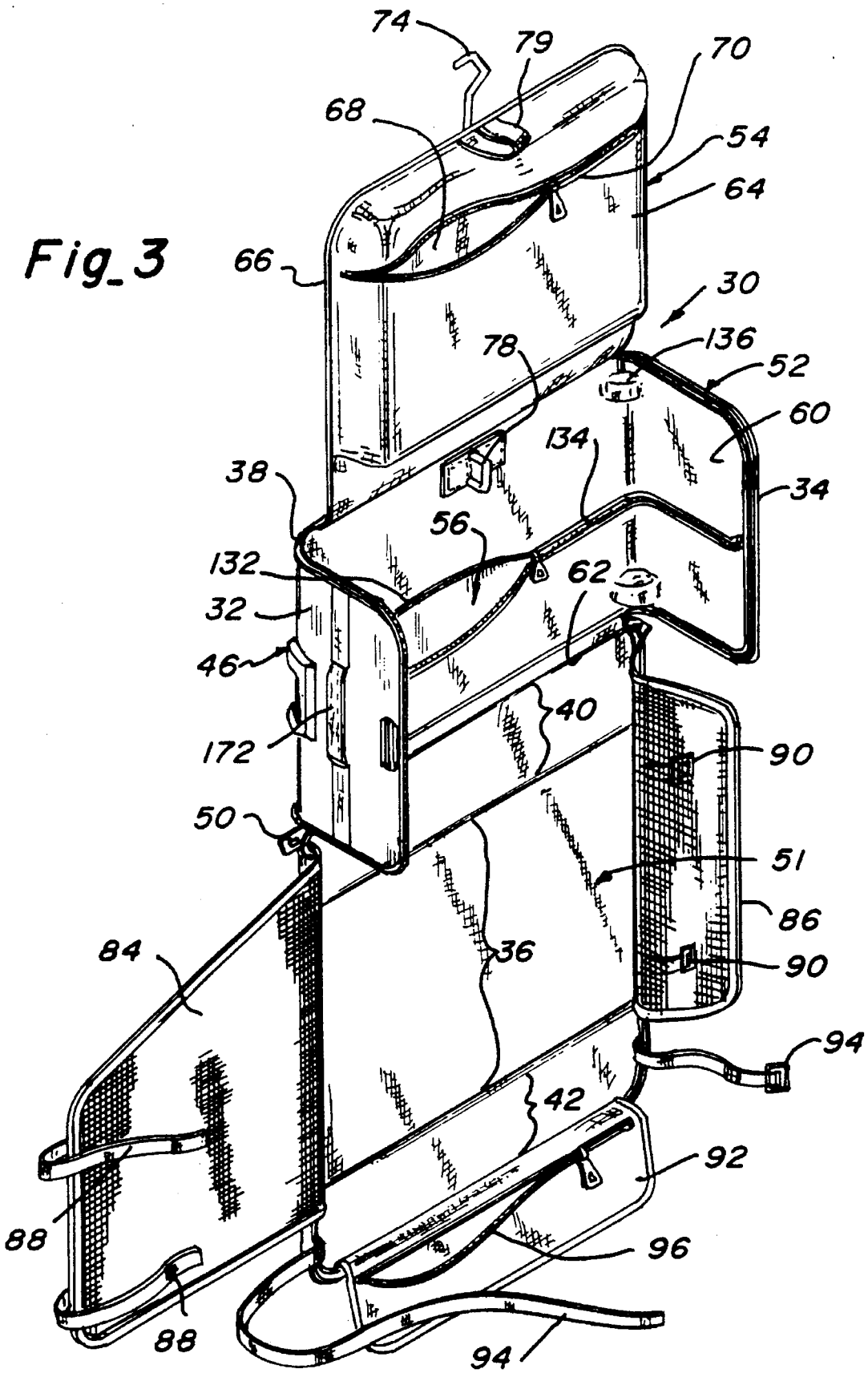
FIG. 3 is a perspective view of the luggage case shown in FIG. 1, shown in an open position ready for packing.
Figure 4:
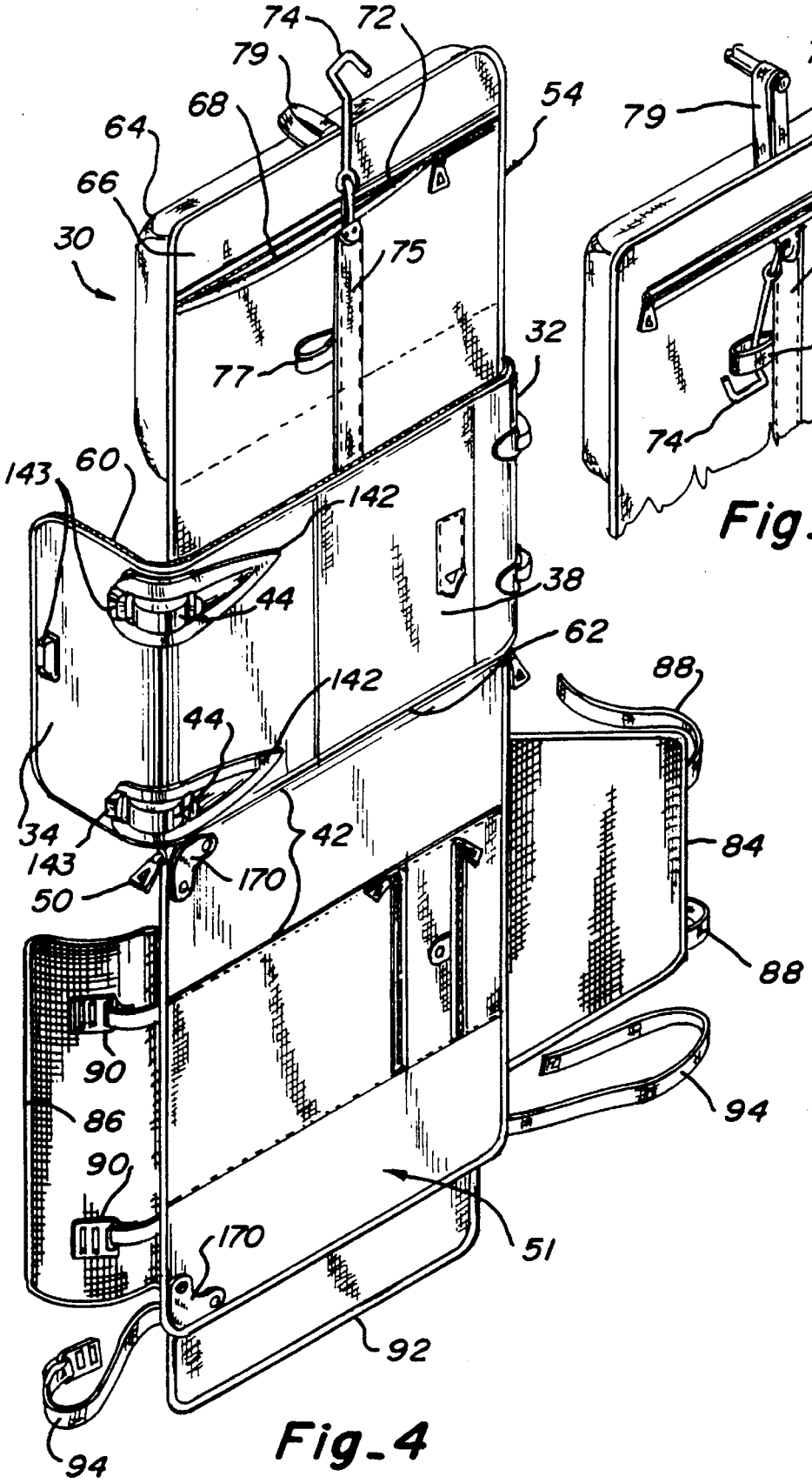
FIG. 4 is a rear perspective view of the luggage case shown in FIG. 3, illustrating the other side of the luggage case in the open position.
Figure 11:
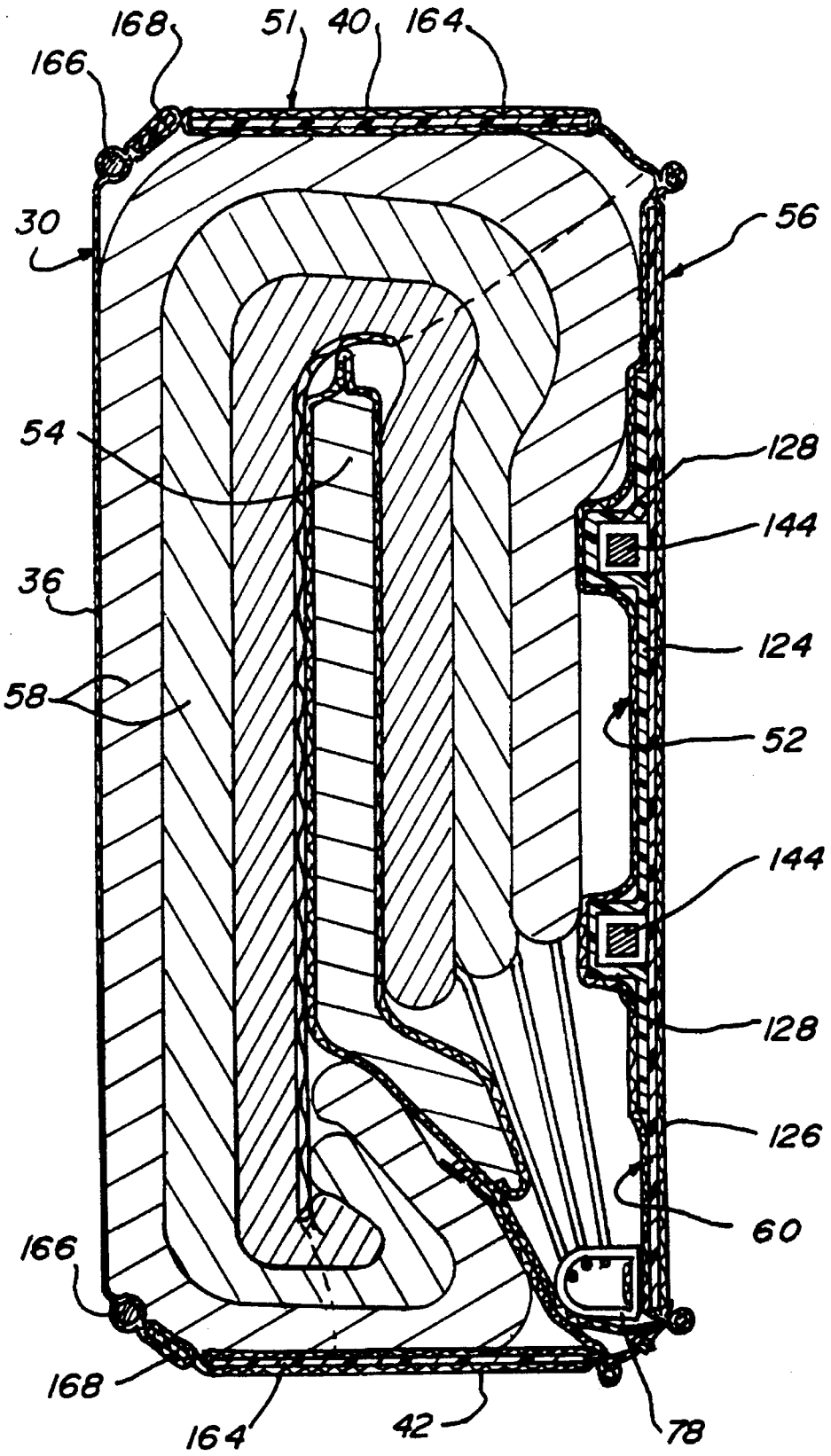
FIG. 11 is a generalized section view of the luggage case in the closed position taken substantially in the plane of line 11—11 of FIG. 1.
Figure 15:
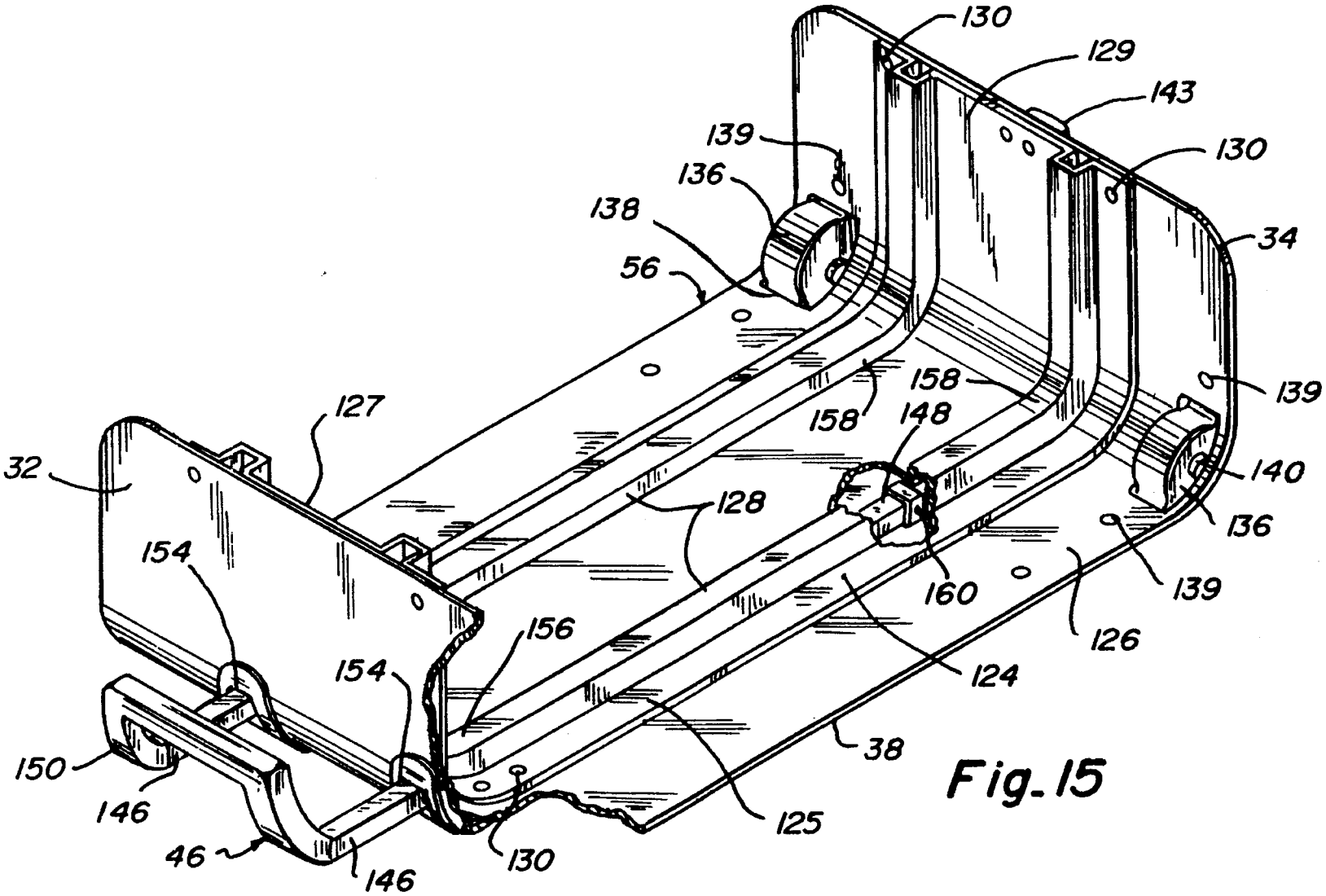
FIG. 15 is a perspective view of a support structure of the luggage case shown in FIGS. 1–11.

When the case 30 is opened from the closed position shown in FIGS. 1 and 2 by opening a zipper 50 and unfolding a single panel 51 which forms the right face 42, the front face 36 and the left face 40, a garment bag 52 and a packing pouch 54 are revealed, as is shown in FIGS. 3 and 4. The top face 32, back face 38 and bottom face 34 are attached to a U-shaped rigid support structure 56 (FIG. 15). The support structure 56 also supports all of the elements of the case 30 and articles 58 (FIG. 5) packed within the case 30 when the case is closed. The garment bag 52 and the packing pouch 54 occupy an interior cavity 60 of the case 30 defined generally by the space within the U-shaped support structure 56 when the case is in the closed position. In the closed position, the garment bag 52 and the packing pouch 54 fold into and interfit between the top face 32 and the bottom face 34 within the interior cavity 60 (FIG. 11).

With the case 30 in the open position as shown in Figs. 3 and 4, the single panel 51 extends away from the back face 38 generally transversely with respect to the general longitudinal orientation of the interior cavity 60 between the top and bottom faces 32 and 34. The left face 42 is connected to the back face 38 of the case 30 along a living hinge 62, which exists because the zipper 50 does not extend completely along the intersection of the left face 42 and the back face 38.

Figure 7:
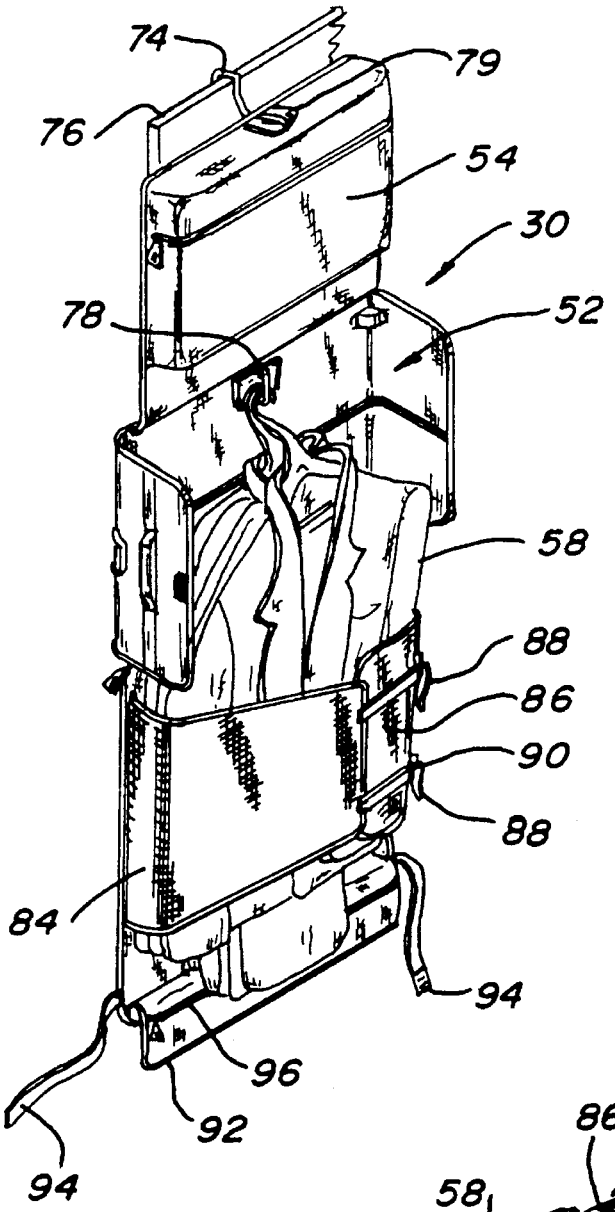
FIG. 7 is a perspective view similar to FIG. 5, illustrating two garment support pieces securing the articles within a garment bag portion of the luggage case.
Figure 8:
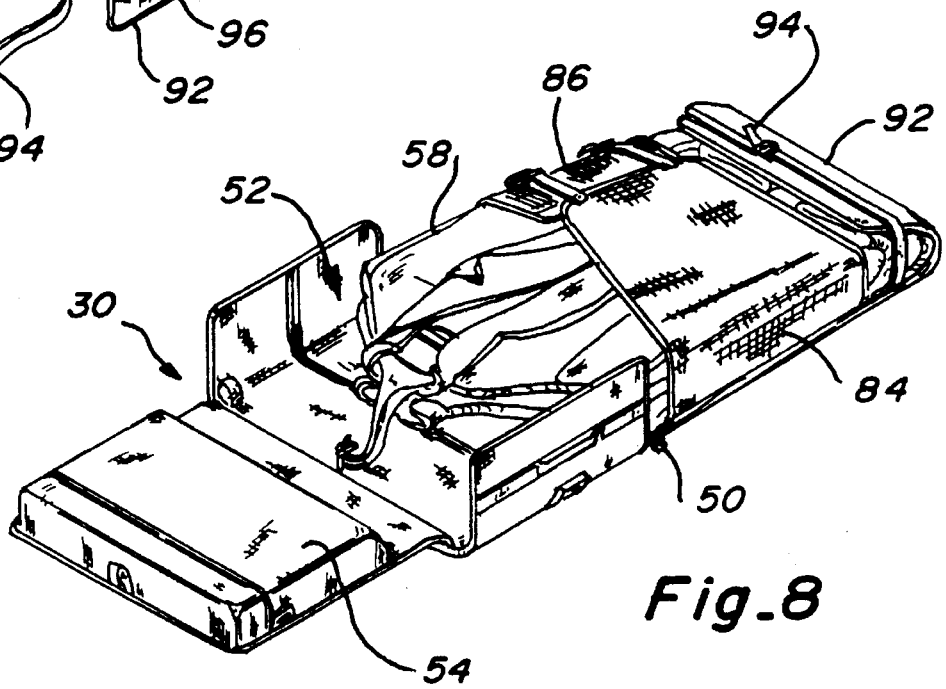
FIG. 8 is a perspective view of the luggage case shown in FIG. 7, lying horizontally.

The packing pouch 54 is attached to the back face 38 on the side opposite of the single panel 51. When the case 30 is in the open position, the packing pouch 54 folds away from the interior cavity 60 substantially into the same plane as the back face 38 and the single panel 51. The packing pouch 54 is formed by two panels 64 and 66 connected together along their marginal edges to form an interior 68 of the pouch 54 into which smaller and lose articles are packed. The panels 64 and 66 have zippered openings 70 and 72, respectively, which allow access to the interior 68 from either side of the pouch 54 when the packing pouch is either folded into the interior of the case (FIG. 9) or unfolded from the interior of the case (FIGS. 7 and 8). The inner marginal edges of the panels 64 and 66 are connected to the support structure 56 on the inside of the zipper 50 as shown in FIG. 3, to allow the zipper 50 to close the case 30.

Figure 5:
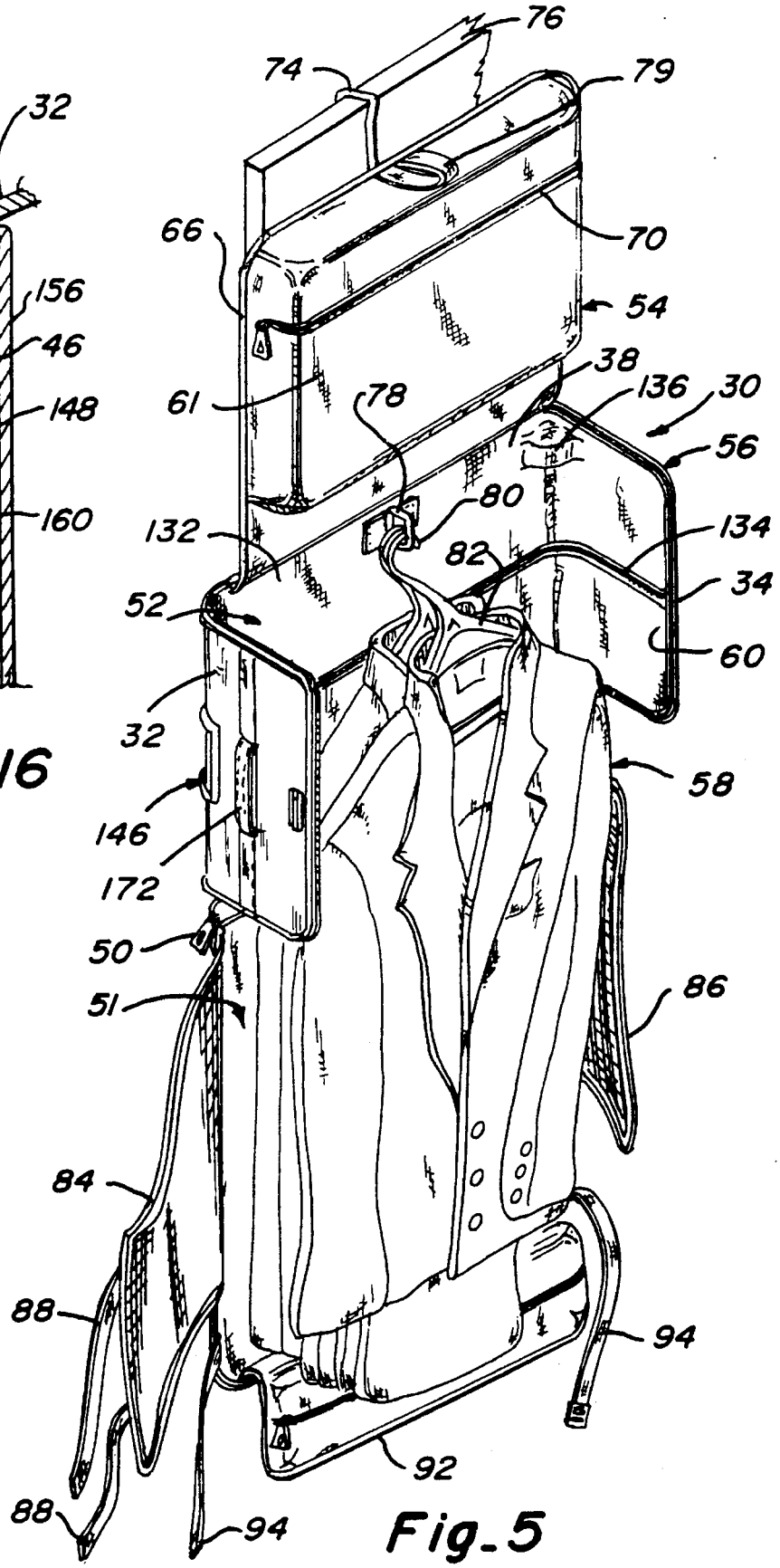
FIG. 5 is a perspective view of the luggage case in the open position as shown in FIG. 3, having articles of clothing placed within the interior of the luggage case during packing.

A hanging hook 74 is fixed to the panel 66 of the packing pouch 54 to support or hang the case 30 from a door 76 or closet bar (not shown) in its extended and open position, as shown in FIG. 5. Hanging in this position, the packing pouch 54, the support structure 56, and panel 51 are all vertically oriented with respect to one another to allow unrestricted access to the packing pouch 54 and the garment bag 52 for packing articles 58. The top and bottom faces 32 and 34 extend forward of the plane of the back face 38 and do not interfere with access to either the packing pouch 54 or the garment bag 52. In this configuration, the case 30 conveniently receives articles 58 to be packed in the same manner as in a traditional garment bag.

Figure 6:
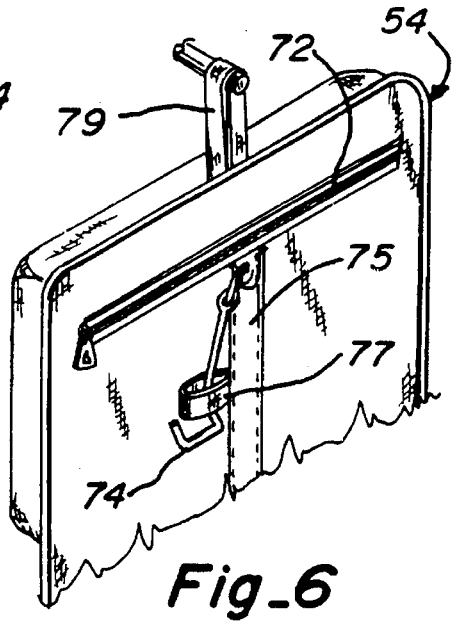
FIG. 6 is a partial perspective view of a portion of FIGS. 4 and 5.

In order to support the considerable weight of the contents of the case 30 as it is packed while hanging from the hanging hook 74, a reinforcing strap 75 is attached to the support structure 56 and extends along the panel 66 and connects to the hook 74, as shown in FIG. 4. The reinforcing strap 75 withstands the weight of the packed case 30 rather than requiring the panel 66 or the packing pouch 54 to carry this weight. The strength of the reinforcing strap 75 allows the panels 64 and 66 to be made of more flexible and less heavy material without compromising the strength and durability of the case 30. When the hanging hook 74 is not in use, it is restrained on the panel 66 by hooking it in a retaining loop An auxiliary lifting loop 79 is attached to the packing pouch 54, as is also shown in FIG. 6. The auxiliary lifting loop 79 is available to be grasped in one hand while the hook 74 is grasped in the other hand, thereby allowing the use of both hands to lift the case to the position where the hook 74 can be hooked over a door 76 or a closet bar (not shown).

A garment hook mechanism 78 is attached in the interior cavity 60 midway between the top and bottom faces 32 and 34 and adjacent to the location where the packing pouch 54 attaches to the back face 38, as shown in FIGS. 3 and 5. The garment hook mechanism 78 holds hooks 80 of clothes hangers 82 when the articles 58 are packed within the garment bag 52. When the clothes hangers 82 are connected to the garment hook mechanism 78, the articles 58 hang down vertically adjacent to the interior of the panel 51. The space of the interior cavity 60 between the outward protruding top and bottom faces 32 and 34 is useful in guiding the garments 58 on the hangers 82 to the garment hook mechanism 78.

To assist in retaining the garments 58 in the garment bag 52, first and second mesh-panel garment support pieces 84 and 86 are attached on opposite edges of the panel 51, as shown in FIGS. 3 and 5. The two garment support pieces 84 and 86 fold over the articles 58 in the garment bag 52 as shown in FIG. 7. The first support piece 84 folds on top of the second support piece 86. Belts 88 are connected to the first garment support piece 84 and extend over the second support piece 86 to connect to buckles 90 which are attached to the panel 51 at the location where the second support piece 86 attaches to the panel 51. The first and second support pieces 84 and 86, along with the belts 88 and buckles 90, hold the articles 58 in place against the panel 51 in the garment bag 52 while the case 30 is closed.

An elongated flexible flap 92 is attached to the edge of the panel 51 at the location where the right face 42 intersects with the back face 38 when the case 30 is closed. The elongated flap 92 folds out from the panel 51 to allow the bottom portions of long articles 58 to lay over the flap 92 initially. The bottom portions of long articles 58 are then folded or doubled back where the flap 92 connects to the panel 51. The flap 92 is then folded on top of the folded over portions of the long articles 58. A restraining strap 94, which is attached on opposite sides of the panel 51 secures the flap 92 over the extended and folded portions of long articles 58. Thereafter the support pieces 84 and 86 are folded over the garments 58 and the doubled back bottom portions of the long garments, and the support pieces 84 and 86 are held in position by connecting the belts 88 and buckles 90 to fully retain the articles 58 in the garment bag 52.

The flap 92 is preferably formed to provide an elongated interior pocket which is accessed by a zipper 96, as shown in FIGS. 5 and 7. The interior pocket within the flap 92 may be advantageously used to pack long narrow articles such as ties or belts, or other articles.

In addition to packing the case when it is in the vertical orientation shown in FIG. 7, the case 30 can also be packed when laid out in a horizontal orientation as shown in FIG. 8.

Figure 9:
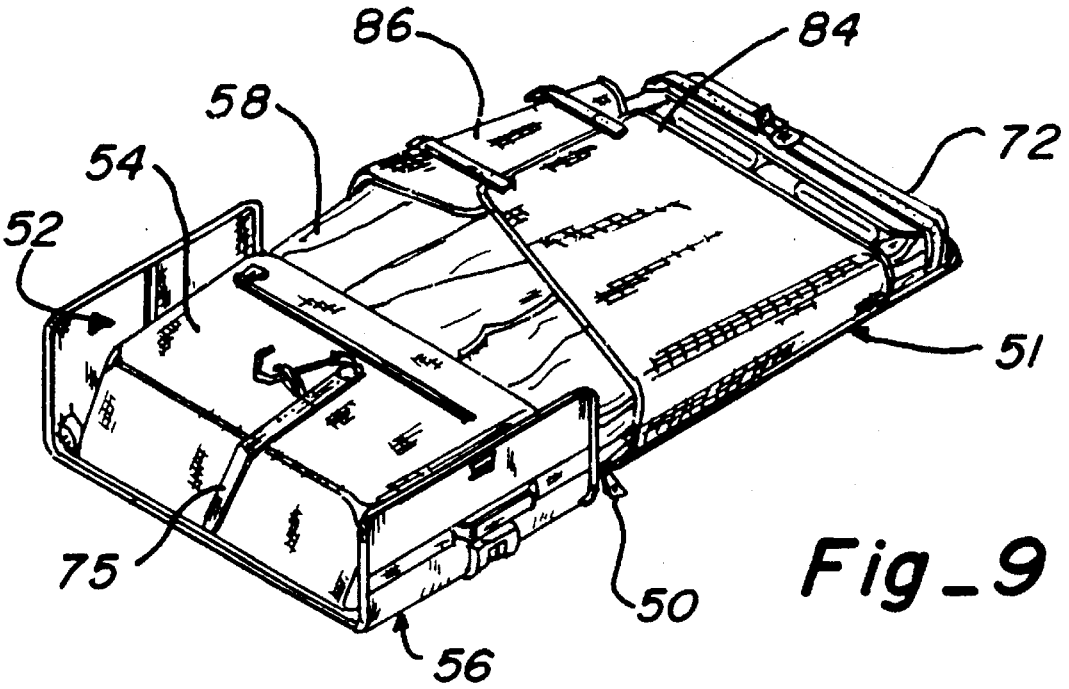
FIG. 9 is a perspective view similar to FIG. 8 showing a packing pouch folded into the interior of the case prior to folding the garment bag to achieve the closed position of the luggage case.
Figure 10:
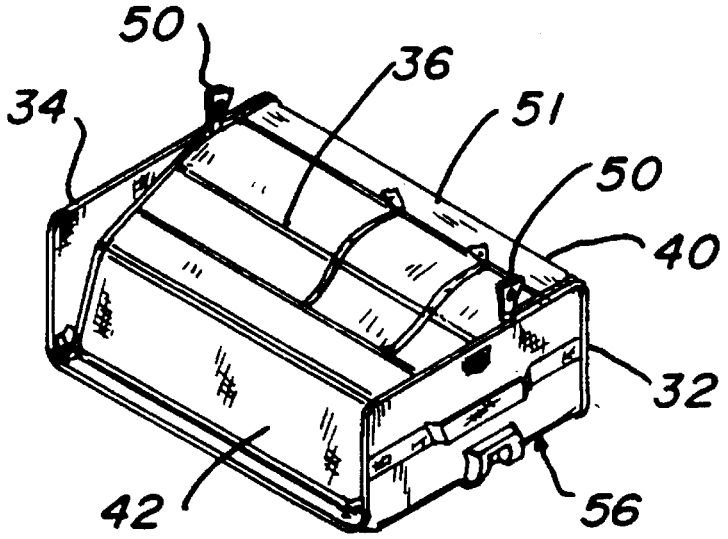
FIG. 10 is a perspective view of the luggage case shown in the next stage of closure after that shown in FIG. 9, with the garment bag folded into the interior of the luggage case and ready for closure into the closed position.

After the garment bag 52 and the packing pouch 54 have been packed, the packing pouch 54 is folded over onto the upper portion of the articles 58 packed into the garment bag 52, as is shown in FIG. 9. The panel 51 of the garment bag 52 is then folded over the packing pouch 54 as shown in FIG. 10. The edges of the panel 51 that form the front face 36, the left face 40 and the right face 42 are then connected to the edges of the upstanding top and bottom faces 32 and 34 and along the edge of the back face 38 adjoining the attachment line of packing pouch 54 by closing the zipper 50. The case 30 is thereby closed (FIG. 1) and is generally reformed into the shape and configuration of a flight bag.

In the closed position, the folded shape of the garment bag 52 and the packing pouch 54 occupy the positions shown in FIG. 11 within the interior cavity 60 of the case 30. Because the right face 42, left face 40 and front face 36 portions of the panel 51 are connected to the top and bottom faces 32 and 34, which are held in position by the support structure 56, the articles 58 of the garment bag 52 are not allowed to fold tightly against one another, thereby avoiding excessive wrinkling and creasing. In addition, by folding the garment bag 52 around the center-located packing pouch 54, the curvature of the bends in the articles 58 is more gentle, which also assists in avoiding wrinkles and creases.

Figure 12:
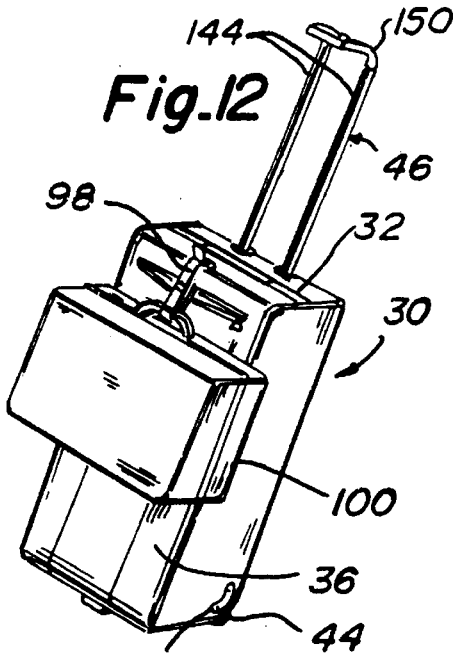
FIG. 12 is a front perspective view of the luggage case shown in FIG. 2, illustrating an auxiliary case attachment mechanism supporting an auxiliary luggage case from the luggage case while it is being moved.

The case 30 also preferably includes an auxiliary luggage case attachment mechanism 98, as is shown in FIG. 12. The attachment mechanism 98 is used for attaching an auxiliary luggage case 100 to the case 30. The auxiliary case 100 rests on and is supported by the upturned front face 36 of the case 30 when the case is closed and is in a pulling or maneuvering position on its wheels. Both luggage cases 30 and 100 can thereby be transported simultaneously by extending the guide handle 46 and pulling the case 30 on the wheels 44.

Figure 13:
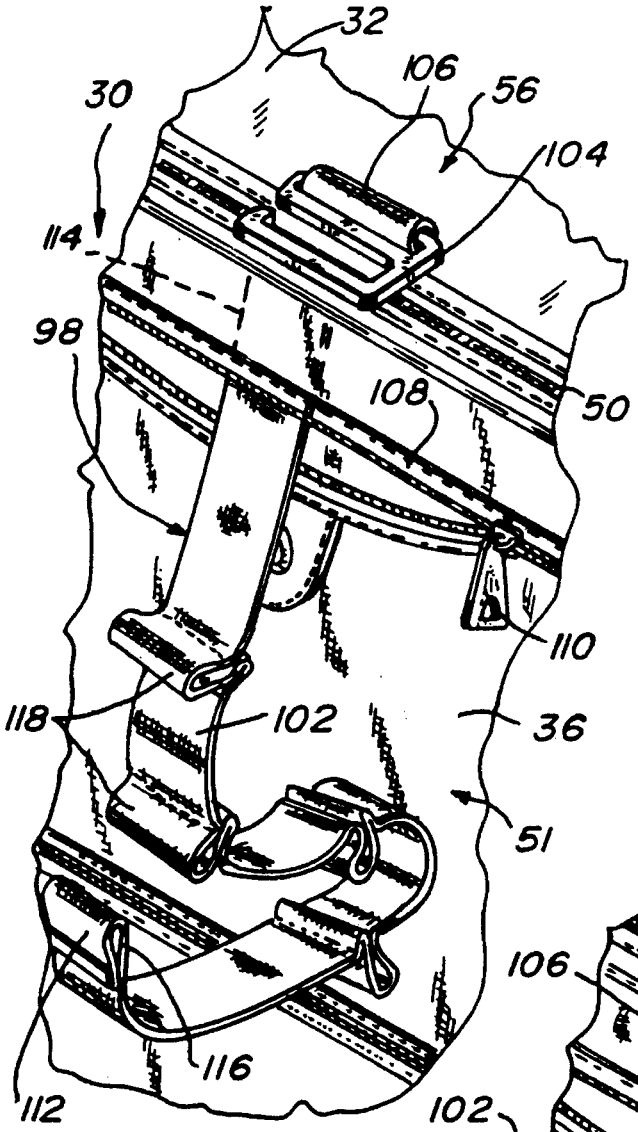
FIG. 13 is an enlarged partial perspective view of the luggage case shown in FIG. 12, illustrating a strap, a hook, and a pocket of the auxiliary case attachment mechanism, with the strap in an extended position but not attached to an auxiliary luggage case.
Figure 14:
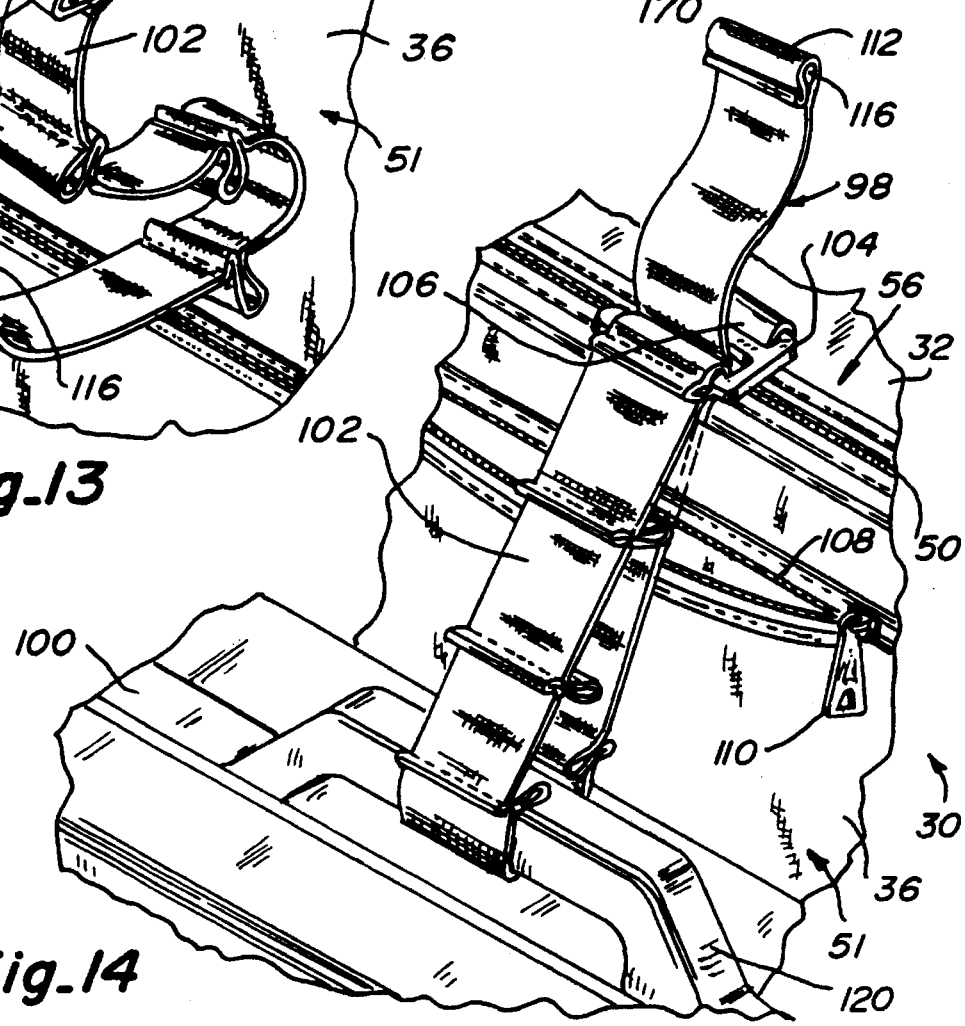
FIG. 14 is a partial perspective view similar to Fig. 13, illustrating the strap and hook of the attachment mechanism supporting an auxiliary luggage case.

The attachment mechanism 98 is located adjacent to the intersection of the front face 36 and the top face 32, as shown in FIGS. 13 and 14. The attachment mechanism 98 comprises a strap 102 and a rigid hook 104, which together act to support the auxiliary luggage case 100 on the front face 36 of the case 30. The rigid hook 104 is attached by a loop 106 to the top face 32 and the support structure 56 of the case 30 adjacent to the top face 32. The strap 102 is confined in a pocket 108 in the front face 36 when it is not in use. Upon opening a zipper 110 to gain access to the pocket 108, a free end 112 of the strap 102 is removed from the pocket 108 and extended to the exterior of the front face 36 of the case 30. The other end 114 of the strap 102 is attached to the front face 36 of the case 30, inside the pocket 108 and near the edge of the panel 51 where the zipper 50 is connected. The free end 112 of the strap 102 is formed in an end loop 116 and a plurality of intermediate loops 118 are also formed in the strap 102 at locations spaced at intervals along its length between the ends 112 and 114.

To attach the auxiliary case 100, the free end 112 of the strap 102 is passed through a handle 120 of the auxiliary luggage case 100 and extended back toward the hook 104, as shown in FIG. 14. One of the plurality of loops 116 and 118 is selected to lift the auxiliary case 100 slightly off of the floor, and the selected loop 118 is attached to the hook 104. The guide handle 46 is extended, the case 30 is levered onto its wheels and both cases 30 and 100 are transported by pulling the case 30 on its wheels. The plurality of loops 116 and 118 adjust the length of the attachment mechanism 98 to accommodate and support a variety of different sizes of auxiliary luggage cases 100. When the attachment mechanism 98 is not in use, the hook 104 lays flat against the top face 32 of the case 30, and the strap 102 is placed in the pocket 108 and the zipper 110 is closed.

The support structure 56 holds the top, bottom and rear faces of the case 30 in position and allows all of the elements of the case 30 to function in the manner described. As shown in FIG. 15, the support structure 56 comprises an internal frame member 124, and a flexible stiffener panel 126 connected to the frame 124. The frame 124 includes a middle portion 125 which extends longitudinally along the back face 38 and curves upwardly into end portions 127 and 129 which are adjacent to the top and bottom faces 32 and 34. Two rectangular (in cross section) channels 128 extend the length of the frame 124 along the end and middle portions 125, 127 and 129 and give the frame member 124 rigidity. The flexible stiffener panel 126 is formed of semi-flexible sheet material such as sheet plastic and is attached to the frame 124 by fasteners 130. The stiffener panel 126 extends along the end and middle portions 125, 126 and 127 and bends around the corners between these portions. The panel 126 extends continuously over the top, back and bottom faces 32, 38, and 34 to provide resilient shape and support for these faces.

Figure 17:
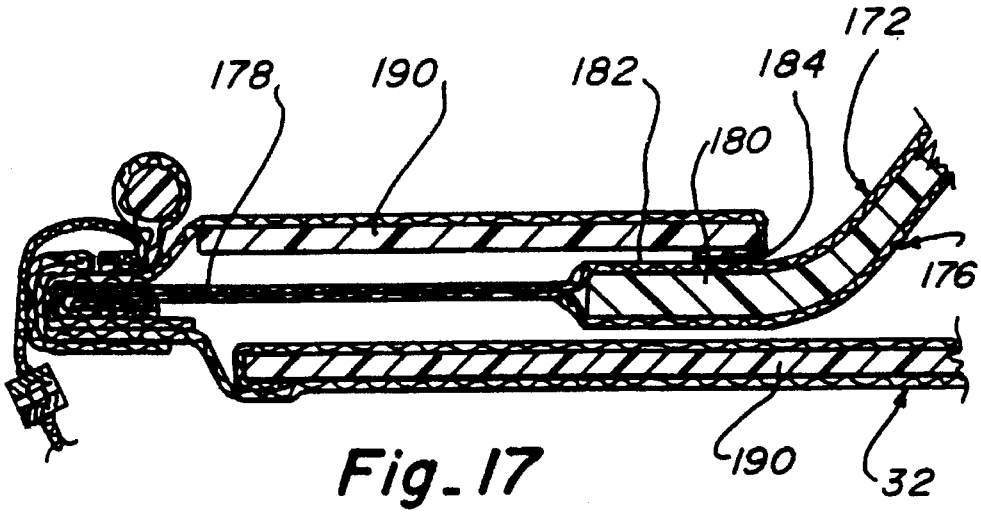
FIG. 17 is a partial section view taken substantially in the plane of line 17—17 of FIG. 2.
Figure 18:
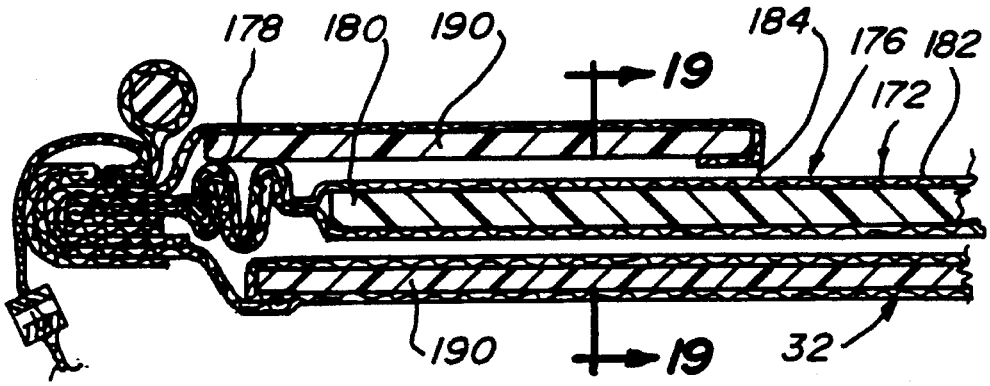
FIG. 18 is a partial section view taken substantially in the plane of line 18—18 of FIG. 1.

The support structure 56 is covered on the exterior by fabric material which completes the formation of the top, bottom and back faces 32, 34 and 38, respectively. Similarly and for aesthetic reasons, the interior of the support structure 56 is covered with a liner 132, as shown in FIG. 3. A zipper 134 allows access through the liner 132 to the support structure 56 as necessary once the support structure is enclosed between the liner 132 and the faces 32, 34 and 38. The stiffener panel 126 allows the fabric of the faces, panel and packing pouch 54 and the zipper 50 to be attached thereto, such as by gluing or sewing if the panel 126 is sufficiently thin, as is shown by FIGS. 17 and 18 for example.

The wheels 44 are spaced apart and rotatably connected to the support structure 56 at the intersection of the back face 38 and the bottom face 34. The wheels 44 are spaced apart a sufficient distance to achieve sufficient stability to avoid tipping the case when it is rolled along an uneven or tilted support surface, around corners, up or down stairs and in general when maneuvering the case.

The wheels 44 are connected to the support structure 56 by wheel housings 136. The wheel housings 136 are positioned in wheel well recesses 138 that are formed in the stiffener panel 126 where it curves from the back face 38 into the bottom face 34. Fasteners 139 connect the wheel housings 136 to the stiffener panel 126. The wheels 44 are rotationally positioned in the wheel housings 136 on axles 140. The housings 136 also include sliders 142 on the exterior of the fabric covering the back face 38 above each of the wheels 44, as shown in FIG. 2. The sliders 142 extend longitudinally along the back face 38 to protect the wheels 44 from becoming damaged when the case 30 is resting on its back face 38 or is being pulled up stairs, for example. Footrests 143 are attached to the stiffener panel 126 on the bottom face 34 to support the case 30 in the upright position so the case does not rest on the wheels 44, as is shown in FIG. 4. The foot rests 143 attached to the sliders 142 are optional. The wheels 44 may serve as foot rests in conjunction with the other foot rests 143 at the opposite edge of the bottom face 34 when the foot rests 143 of the slider 142 are not employed.

The guide handle 46 is connected to the support structure 56 to extend from the case 30 for use in maneuvering the case, as shown in FIG. 2, and to retract into the case when the guide handle is not in user as shown in FIG. 1. The guide handle 46 comprises two parallel shafts 144, each having a first or upper end 146 and a second or lower end 148, and a hand grip 150 attached to the upper ends 146 of each shaft 144. The hand grip 150 is preferably contoured to lie adjacent to the top face 32 of the case 30 when the guide handle is fully retracted, as shown in FIG. 1.

An interior space 152 within the channels 128 and enclosed by the stiffener panel 126 serves as a guide for each shaft 144, and each shaft is slidably received and confined within the guide space 152, as shown in FIG. 11. Apertures 154 are formed in the stiffener panel 126 at first or upper ends 156 of the channels 128 located adjacent to the curved intersection of the back face 38 and the top face 32 to allow the shafts 144 to extend through the stiffener panel 126. Second or lower ends 158 of the channels 128 are located adjacent to the curved intersection of the back face 38 and the bottom face 34.

The guide space 152 within the channels 128 is of a dimension slightly larger than the shafts 144 to allow the shafts to slide inside the guide space 152, yet maintain directional stability over the case 30 during extension of the guide handle 46 and movement on the wheels. When in the fully retracted position, the second end 148 of each shaft 144 is adjacent to the lower end 158 of the channel 128, while the upper ends 146 of the shafts are adjacent to the upper ends 156 of the channel.

Figure 16:
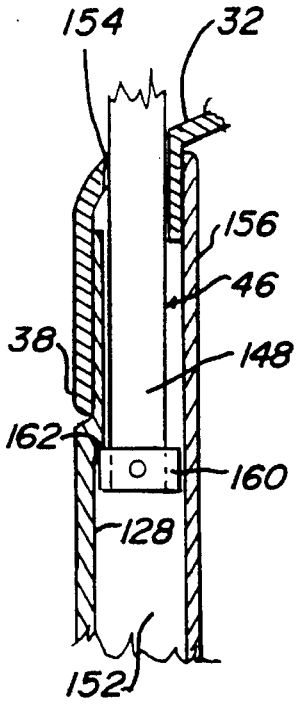
FIG. 16 is a partial section view taken in the plane of line 16—16 of FIG. 2.

A collar 160 is attached at the lower end 148 of each of the shafts 144. The collar 160 contacts a stop 162 formed by a reduced cross sectional portion of the channel 128 at the upper end 156 of the guide channels when the guide handle 46 is fully extended, as shown in FIG. 16. The engagement of the stop 162 with the collar 160 keeps the guide handle 46 from being pulled entirely out of the guide channels and the case 30.

The zipper 50 extends continuously along a perimeter edge of the stiffener panel 126 adjacent to the edges of the top and bottom faces 32 and 34 and adjacent to the edge where the right face 42 connects to the face back 38. When the panel 51 is connected to the top, bottom and back panels 32, 34, and 38 by closing the zipper 50, the support structure 56 positions the panel 51 with the front face 36, the left face 40 and the right face 42 directly extending between the edges of the top and bottom faces held in position by the support structure 56. The support structure thus establishes and maintains the rectangular prismatic configuration of the case 30 in the shape and general size of a flight bag. In this closed position, the zipper connection 50 of the panel 51 to the faces 32, 34 and 38 is somewhat similar to the interfitting connection of the two-piece cover on a baseball.

To assist in maintaining the prismatic shape of the case 30 when in the closed position, the left and right faces 40 and 42 include semi-flexible stiffener panels 164, as are shown in FIG. 11. In addition, a rod 166 is positioned within the panel 51 at the intersection of the front face 36 and the right face 42 and at the intersection of the front face 36 and the left face 40. Elongated stiffener bars 168 are also positioned within the panel 51 between the rod 166 and the stiffener panels 164. The stiffener panels 164, the rods 166 and the elongated stiffeners 168 extend between the top and bottom faces 32 and 34 to provide corner integrity and shape to the intersections of the front face 36 with each of the left or right faces 40 and 42 when the case is in the closed position.

A corner protector 170 is attached to each of the right and left faces 40 and 42 at the intersection of the back and bottom faces 38 and 34, respectively, adjacent each wheel, as is shown in FIGS. 4 and 12. The corner protectors 170 are connected to the stiffener panels 164. The corner protectors 170 prevent scuffing the of the exterior fabric on the case 30 at the otherwise vulnerable corners adjacent to the wheels. This position is the most likely to encounter objects on the floor or support surface as the case is maneuvered on its wheels.

Figure 19:
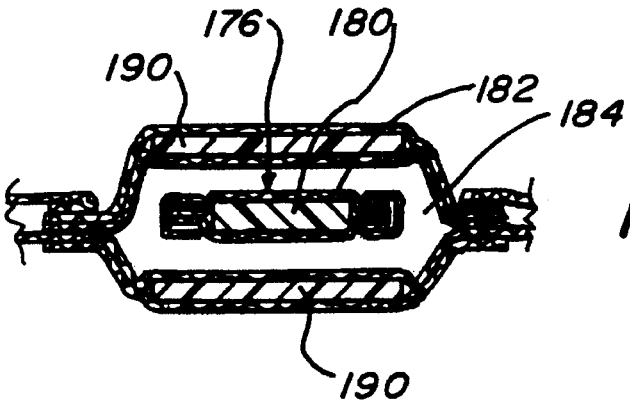
FIG. 19 is a section view taken in the plane of line 19—19 of FIG. 18.

A carry handle 172 is attached on the top face 32 of the case 30, as shown in FIGS. 1 and 2. The carry handle 172 is used to carry the case 30 by hand while suspended in the traditional manner. The carry handle 172 comprises an elongated center gripping portion 176 with two flexible end pieces 178, as shown in FIGS. 17, 18, and 19. The gripping portion 176 has a semi-rigid core 180 surrounded by flexible sheath material 182 which forms the end pieces 178. The end pieces 178 are connected or sewn to the edges of the top face 32, where the exterior fabric material, the interior liner 132 and the zipper 50 are connected, as shown in FIGS. 17 and 18.

The gripping portion 176 extends between two slots 184 formed in the exterior fabric material covering the top face 32. Reinforcements 190 are attached in the fabric above and below the slots and extend to the edges of the top face 32 parallel to the end pieces 178. Each flexible end piece 178 is received within the elongated slot 184. The core 180 only extends partially into each slot 184.

When the carry handle 172 is not in use, it can be pushed down flush against the top face 32, as shown in FIG. 18. In the flush position, the ends of the core material 180 extend into the slots 184. The flexible end pieces 178 bunch up in the slot 184 to allow the carry handle 172 to lay flush with the top face 32. When the user wishes to carry the case 30 by the carry handle 172, the user pulls the carry handle 172 away from the top face 32. The core 180 pulls almost entirely out of the elongated slot 184, and the flexible end pieces 178 straighten out and become taught. Any further extension of the carry handle 172 is restricted because of the connection of end pieces to the edges of the top face 32. This connection allows the weight of the case 30 and its contents to be supported by the handle 172. The reinforcements 190 distribute the weight over a larger area of the exterior fabric material covering the top face.

To use the case 30, it is first opened from the closed position to the open position. The panel 51 is separated from the faces 32, 34 and 38 by unzipping the zipper 50 that connects perimeters of the panel 51 and the support structure 56. Once the zipper 50 has been opened, the panel. 51 is folded away from the support structure 56 about the living hinge 62. The packing pouch 54 is then unfolded from the interior of the support structure 56 to extend in-line with the support structure 56 and the panel 51.

The hanging hook 74 and the grasping loop 79 are then gripped and the case 30 is lifted. The hook 74 is attached to an object, for instance a door 76, and the extended case 30 hangs in a vertical manner. The garment support pieces 84 and 86 are then disconnected from the panel 51. The restraining strap 94 is disconnected and the flap 92 folds away from the interior of the garment bag 52 to facilitate packing the interior of the case 30. Rather than hanging the case 30 vertically, the user may also position the case for packing in a horizontal open position.

Articles 58 on garment hangers 82 are then packed into the case by placing the hooks 80 of the garment hangers on the garment-hook mechanism 78. The support pieces 84 and 86 are then laid over the articles and fastened into place to secure the articles in a stable position. Articles are also backed into the packing pouch 54.

After any packing of the flexible flap 92, if it is to be used, the flexible flap 92 is folded back towards the interior of the panel 51 and over the articles that extend below the garment support pieces 84 and 86. The restraining strap 94 is then refastened to hold the flexible flap 92 in its folded position. If long garments are packed,, the flap 92 is folded over first and then the long portions of the garments are held beneath the garment support pieces 84 and 86.

The packing pouch 54 is then folded into the interior cavity 60 of the case 30 and rests on the articles 58 that have been placed in the garment bag 52. The panel 51 is then folded over and connected with the top, bottom and rear faces 32, 34 and 38. Since the articles are held in place in the garment bag 52 by the garment support pieces 84 and 86, the articles 58 pack neatly around the packing pouch 54, as shown in FIG. 11. Once the panel 51 has been folded over the support structure 56, the zipper 50 is then operated to reattach the perimeters of the panel and support structure forming the rectangular prismatic configuration of the case 30.

The case 30 is ready to be transported after the panel 51 and support structure 56 have been reconnected together by the zipper 50. The user can carry the case 30 using the carry handle 172, or the user can maneuver the case by extending the guide handle 46 and pulling the case along a support surface on the wheels 44. The user also has the option of attaching an auxiliary luggage case 100 using the auxiliary luggage case attachment mechanism 78 to transport more than one luggage case at the same time.

Among numerous other improvements, the case 30 of the present invention advantageously allows garments to be packed in a flight-bag style luggage case in the convenient manner that they are packed in a traditional garment bag. The garment bag style packing allows simple and convenient organization of the articles placed in the case. The wheels allows the case to be moved relatively easily without carrying the case. The two wheels achieve a highly effective degree of maneuverability in tight and crowded spaces. The auxiliary luggage attachment capability allows additional luggage to be transported with relatively additional effort. The flight bag size and configuration allows the user to stow the luggage case under the seat or in the overhead compartment, thus achieving the conveniences of carry-on luggage.

A presently preferred embodiment of the present invention and many of its improvements have been described with a degree of particularity. This description has been made by way of preferred example. It should be understood, however, that the scope of the present invention is defined by the following claims, and not necessarily by the detailed description of the preferred embodiment.

The invention claimed:

1. A luggage case having a generally rectangular prismatic configuration of a size and shape similar to a flight bag when in a closed position and presenting a garment bag configuration for packing clothes when the case is in an open position, comprising:

a rigid support structure for the case, said support structure having a U-shape and defining a plurality of edges, said edges forming a perimeter;

a flexible exterior panel connected to one of said plurality of edges of the support structure and extendable laterally from the support structure to expose an interior of the panel and the case, the panel forming an exterior wall of the garment bag configuration, the extended panel having a plurality of edges forming a perimeter;

a selective attachment device connecting the perimeter of the panel to the perimeter of the support structure to complete the prismatic configuration when the case is in the closed position and to generally enclose the interior of the case;

a first broad flexible laminar support piece fixedly connected to an end of the interior of the panel adjacent to and along one of the plurality of edges of the panel at a position to overlap clothes extending along the panel when packed in the garment bag configuration;

a second broad flexible laminar support piece fixedly connected to the interior of the panel adjacent to and along the edge of the panel opposite the attachment of the first flexible support piece, at a position to overlap clothes extending along the panel;

the first laminar support piece substantially corresponding to the panel in size and having a width sufficient to overlap the second support piece, thus holding the clothes against the panel and generally in the garment bag configuration peripherally around the interior of the case when in the closed position; and a packing pouch having an interior into which to pack articles, the packing pouch having an edge connected to and along the edge of the support structure opposite the exterior panel, the connection forming a living hinge, allowing the packing pouch to extend from the interior of the case oppositely of the panel when the case is in the open position, the packing pouch folding into the interior of the case to be substantially surrounded by the clothes when the case is in the closed position.

2. A luggage case as defined in claim 1, further comprising:

a wheel rotatably attached to the support structure and adapted to engage a support surface and to allow the case to be moved by rolling the wheel on the support surface.

3. A luggage case as defined in claim 2, further comprising:

an elongated extendable and retractable guide handle slidably connected to the support structure to extend from the case to guide the case on the wheel along the support surface when the case is in the closed position, the guide handle extending and retracting along its length.

4. A luggage case as defined in claim 3, wherein:

the support structure has a top face and a front face; and further comprising:

an auxiliary luggage case attachment mechanism fixed to the top face and the front face of the support structure and adapted to carry an auxiliary luggage case upon the front face of the closed luggage case.

5. A luggage case as defined in claim 4, wherein the attachment mechanism comprises:

a rigid hook attached to the top face;

an elongated flexible strap having a first end attached to the front face and a second end having sufficient length to extend through a handle of the auxiliary luggage case and return to the hook; and at least one loop formed along the length of the strap to engage the hook.

6. A luggage case as defined in claim 1, where the case in the closed position has a front face, a back face, a right face, a left face, a top face and a bottom face, and wherein:

the panel comprises the substantial majority of the right face, front face and left face;

the support structure extends substantially along the top face, the back face and the bottom face, portions of the top face, the bottom face and the back face defining a second perimeter; and the selective attachment device is adapted to selectively disconnect and connect the panel to the top face and the bottom face and the back face, and maintain the faces generally in the form of a rectangular prismatic flight bag configuration.

7. A luggage case as defined in claim 1, further comprising:

a hanging hook attached to the packing pouch for supporting the case vertically in the open position.

8. A luggage case as defined in claim 7, wherein:

the case is in a vertical orientation when suspended by the hanging hook, with the support structure suspended adjacent to and below the packing pouch, and the panel suspended adjacent to and below the support structure.

9. A luggage case as defined in claim 1, further comprising:

a garment-hook mechanism attached to the interior of the support structure to connect to hooks of hangers which support articles packed in the garment bag configuration.

10. A luggage case as defined in claim 1, wherein:

said support structure has an exterior covering defining two slots, and further comprising:

a carry handle having an elongated center gripping portion with opposing flexible ends, the flexible ends each extending through one of the slots formed in the exterior covering and attaching to the support structure; and the carry handle being extendable above the support structure for carrying the case, causing the flexible ends to extend, and being retractable to lie substantially flush with the support structure when not used to carry the case, forcing the flexible ends to bunch up under the exterior covering.

11. A luggage case as defined in claim 1, further comprising:

an elongated pocket having a width dimension significantly less than its length dimension, said elongated pocket attached to the panel opposite of the location where the panel attaches to the support structure and having an interior into which to pack articles, the attachment between the pocket and the panel forming a living hinge, the elongated pocket folding about the living hinge away from and into the interior of the panel to overlap only the bottoms of articles packed in the garment bag configuration of the case.

12. A flight bag style luggage case which has a rectangular prismatic shape in a closed position, the case formed by a top face, a bottom face, a right face, a left face, a front face and a back face, the top face opposing the bottom face and both the top and bottom faces extending in the length and width dimension of the prismatic shape, the right face and the left face opposing one another and extending in the height and length dimension of the prismatic shape, and the front face and the back face opposing one another and extending in the height and width dimensions of the prismatic shape, the prismatic shape enclosing an interior adapted for receiving garments, the flight bag being openable to an open position to expose the interior for packing the garments, said case comprising, in the open position:

a rigid support structure connected to the top face, the back face and the bottom face, the support structure rigidly holding the faces in a U-shape, the support structure having a plurality of edges forming a first perimeter;

a panel comprising the left face, the front face and the right face, each face being flexibly attached together, the panel having a second perimeter, the panel also forming a part of an integral garment bag for receiving the garments;

a first living hinge connecting the left face and the back face and attaching the support structure to the panel at positions other than the first and second perimeters;

a selectively closeable fastener attached along the first perimeter to form the prismatic shape when the fastener is connected to close the case; and a packing pouch having an interior into which to pack articles, the packing pouch connected to the support structure at a location within the interior of the case generally adjacent to the intersection of the right face and the back face when the case is in the closed position, the connection between the packing pouch and the support structure forming a second living hinge, the packing pouch folding about the second living hinge and extending away from the interior of the case in the opposite direction of the extension of the panel away from the interior of the case when the case is in the open position, and the packing pouch folding about the second living hinge into the interior of the case and substantially across the width of the back face to be surrounded by the garments in the garment bag when the case is in the closed position.

13. A luggage case as defined in claim 12, further comprising:

a hanging hook attached to the packing pouch at a location opposite of the location where the packing pouch is attached to the support structure, the hanging hook vertically suspending the case when in the open position.

14. A luggage case as defined in claim 12, further comprising:

at least one wheel rotatably attached to the support structure to engage a support surface and allow the case to be moved on the support surface by rolling the case when in the closed position; and an elongated extendable and retractable guide handle slidably connected to the support structure and extendable from and retractable into the case, the guide handle extendable to guide the case on each wheel along the support surface when the case is in the closed position, the guide handle extending and retracting along its length.

15. A luggage case as defined in claim 14, further comprising:

an attachment mechanism fixed to the top face and the front face of the support structure to attach an auxiliary luggage case to the front face of the flight bag in the closed position, the attachment mechanism comprising:

a rigid hook attached to the top face;

an elongated flexible strap having a first end attached to the front face, a second end, and having sufficient length to extend through a handle of the auxiliary luggage case and return to the hook; and at least one loop formed along the length of the strap to engage the hook.

16. A luggage case having a generally rectangular prismatic configuration of a size and shape similar to a flight bag when in a closed position and presenting a garment bag configuration for packing clothes in a garment bag style when the case is in an open position, comprising:

a rigid support structure to support the case, the support structure having a U-shape and defining a plurality of edges forming a perimeter;

a flexible exterior panel connected to the support structure along one of said plurality of edges, and extendable laterally away from the support structure exposing the interior of the panel and the support structure, and forming an exterior wall of the garment bag configuration when the case is in the open position, the extended panel having a perimeter;

a selective attachment device connecting the perimeter of the panel to the perimeter of the support structure to complete the prismatic configuration when the case is in the closed position and to generally define an interior volume of the case; and a packing pouch having an interior into which to pack articles, the packing pouch having a first edge flexibly connected to the support structure adjacent to the edge of the support structure opposite the location of the attachment of the panel to the support structure to allow the packing pouch to fold away from the support structure when the case is in the open position and to allow the packing pouch to fold into the interior of the case and be surrounded by the clothes in the garment bag configuration when the bag is in the closed position.

17. A luggage case as defined in claim 16, wherein:

a hanging hook is attached to the packing pouch opposite of the edge where the panel is attached to the support structure, the case depending from the hanging hook when in the open position and suspended by the hook.

18. A luggage case as defined in claim 17, wherein:

the hook is adapted to suspend the case from an object when the case is in the open position;

the packing pouch has a front side and a back side, the front side facing toward the support structure and the back side facing away from the support structure when the case is in the closed position; and the hanging hook is attached to the back side of the packing pouch.

19. A luggage case as defined in claim 18, further comprising:

a reinforcing strap attached to the support structure and extending along the back side of the packing pouch; and wherein:

the hanging hook is attached to the reinforcing strap to transfer the weight of the case to the support structure when the case is hung by the hanging hook and avoiding the application of weight on the packing pouch when the case is in the open position and the packing pouch is extended for convenient packing.

20. A luggage case as defined in claim 19, further comprising:

a selectively closeable opening formed in the front and back sides of the packing pouch to obtain selective access to the interior of the packing pouch.

21. A luggage case as defined in claim 16, further comprising:

at least one wheel rotatably attached to the support structure to engage a support surface and allow the case to be moved by rolling it on the wheels on the support surface when the case is in the closed position; and an elongated extendable and retractable guide handle slidably connected to the support structure to extend from the case to guide the case on each wheel along the support surface when the case is in the closed position, the guide handle extending and retracting along its length.

22. A luggage case having a generally rectangular prismatic configuration of a size and shape similar to a flight bag when in a closed position and presenting a garment bag configuration for packing clothes when the case is in an open position, comprising:

a rigid support structure for the case, said support structure having an interior and defining a plurality of edges, said edges forming a perimeter;

a flexible exterior panel connected to one of said plurality of edges of the support structure, and extendable laterally from the support structure to expose an interior of the panel and the case, the panel forming an exterior wall of the garment bag configuration, the extended panel having a plurality of edges forming a perimeter;

a selective attachment device connecting the perimeter of the panel to the perimeter of the support structure to complete the prismatic configuration when the case is in the closed position and to generally enclose the interior of the case;

a broad flexible laminar support piece, substantially corresponding to the panel in size, connected to an end of the interior of the panel adjacent to the perimeter of the panel and at a position to overlap clothes extending along the panel when packed in the garment bag configuration;

a wheel rotatably attached to the support structure and adapted to engage a support surface and to allow the case to be moved by rolling the wheel on the support surface;

an elongated extendable and retractable guide handle slidably connected to the support structure to extend from the case to guide the case on the wheel along the support surface when the case is in the closed position, the guide handle extending and retracting along its length; and an auxiliary luggage case attachment mechanism fixed to a top face and a front face of the luggage case and adapted to carry an auxiliary luggage case upon the front face of the closed luggage case, said attachment mechanism comprising:

a rigid hook attached to the top face;

an elongated flexible strap having a first end attached to the front face and a second end having sufficient length to extend through a handle of the auxiliary luggage case and return to the hook; and at least one loop formed along the length of the strap to engage the hook.

23. A luggage case having a generally rectangular prismatic configuration of a size and shape similar to a flight bag when in a closed position and presenting a garment bag configuration for packing clothes when the case is in an open position, comprising:

a rigid support structure for the case, said support structure having an interior and defining a plurality of edges, said edges forming a perimeter;

a flexible exterior panel connected to one of said plurality of edges of the support structure, and extendable laterally from the support structure to expose an interior of the panel and the case, the panel forming an exterior wall of the garment bag configuration, the extended panel having a plurality of edges forming a perimeter;

a selective attachment device connecting the perimeter of the panel to the perimeter of the support structure to complete the prismatic configuration when the case is in the closed position and to generally enclose the interior of the case;

a broad flexible laminar support piece, substantially corresponding to the panel in size, connected to an end of the interior of the panel adjacent to the perimeter of the panel and at a position to overlap the clothes extending along the panel when packed in the garment bag configuration;

a packing pouch having an interior into which to pack articles, the packing pouch having an edge connected to and along the edge of the support structure opposite the exterior panel, the connection forming a living hinge, allowing the packing pouch to extend from the interior of the case oppositely of the panel when the case is in the open position, the packing pouch folding into the interior of the case to be substantially surrounded by the clothes in the garment bag configuration when the case is in the closed position; and a rigid hanging hook pivotably attached to the packing pouch for supporting the case vertically in the open position.

24. A luggage case as defined in claim 23, wherein:

the hanging hook is adapted to secure the case in the open position from an object such as a door or a closet clothing rod;

the packing pouch has a front side and a back side, the front side facing toward the support structure and the back side facing away from the support structure when in the closed position; and the hanging hook is attached to the back side of the packing pouch and is extendable from the back side of the packing pouch to support the case in the open position and is retractable to the packing pouch when not supporting the case.

25. A luggage case as defined in claim 24, further comprising:

a reinforcing strap attached to the support structure and extending along the back side of the packing pouch; and wherein:

the hanging hook is attached to the reinforcing strap; and the reinforcing strap transfers the weight of the case from the hanging hook to the support structure when the case is supported vertically in the open position.

26. A luggage case having a generally rectangular prismatic configuration of a size and shape similar to a flight bag when in a closed position and presenting a garment bag configuration for packing clothes in a garment bag style when the case is in an open position, comprising:

a rigid support structure to support the case, the support structure defining a plurality of connected edges forming a perimeter;

a flexible exterior panel connected to the support structure along one of said plurality of edges, and extendable laterally away from the support structure to expose the interior of the panel and the support structure, and to form an exterior wall of the garment bag configuration when the case is in the open position, the extended panel having a perimeter;

a selective attachment device connecting the perimeter of the panel to the perimeter of the support structure to complete the prismatic configuration when the case is in the closed position and to generally enclose an interior volume of the case; and a packing pouch having an interior into which to pack articles, the packing pouch having a first edge flexibly connected to the support structure adjacent to the edge of the support structure opposite the location of the attachment of the panel to the support structure to allow the packing pouch to fold away from the support structure when the case is in the open position and to allow the packing pouch to fold into the interior of the case and be surrounded by the clothes in the garment bag configuration when the bag is in the closed position; and a rigid hanging hook pivotably attached to the packing pouch opposite of the edge where the panel is attached to the support structure, the case depending from the hanging hook when in the open position and suspended by the hook.

27. A luggage case as defined in claim 26, wherein:

the hook is adapted to suspend the case from an object when the case is in the open position;

the packing pouch has a front side and a back side, the front side facing toward the support structure and the back side facing away from the support structure when the case is in the closed position;

the hanging hook is attached to the back side of the packing pouch; and the hanging hook is extendable from the back side of the packing pouch to attach to the object and suspend the case when the case is in the open position, the hanging hook is also retractable to the back side of the packing pouch when not used for suspending the case from the object.

28. A luggage case as defined in claim 27, further comprising:

a reinforcing strap attached to the support structure and extending along the back side of the packing pouch; and wherein:

the hanging hook is attached to the reinforcing strap to transfer the weight of the case to the support structure when the case is hung by the hanging hook and avoiding the application of weight on the packing pouch when the case is in the open position and the packing pouch is extended for convenient packing.

29. A luggage case as defined in claim 28, further comprising:

a selectively closeable opening formed in the front and back sides of the packing pouch to obtain selective access to the interior of the packing pouch.

30. A luggage case having a generally rectangular prismatic configuration of a size and shape similar to a flight bag when in a closed position and presenting a garment bag configuration for packing clothes when the case is in an open position, comprising:

a rigid support structure for the case, said support structure having a U-shape and defining a plurality of edges, said edges forming a perimeter;

a flexible exterior panel connected to one of said plurality of edges of the support structure and extendable laterally from the support structure to expose an interior of the panel and the case, the panel forming an exterior wall of the garment bag configuration, the extended panel having a plurality of edges forming a perimeter;

a selective attachment device connecting the perimeter of the panel to the perimeter of the support structure to complete the prismatic configuration when the case is in the closed position and to generally enclose the interior of the case;

a broad flexible laminar support piece fixedly connected to an end of the interior of the panel adjacent to and along one of the plurality of edges of the panel at a position to overlap clothes extending along the panel when packed in the garment bag configuration;

said laminar support piece substantially corresponding to the panel in size and holding the clothes against the panel and generally in the garment bag configuration peripherally around the interior of the case when in the closed position; and a packing pouch having an interior into which to pack articles, the packing pouch connected to and along the edge of the support structure opposite the exterior panel, the connection forming a living hinge, allowing the packing pouch to extend from the interior of the case oppositely of the panel when the case is in the open position, the packing pouch folding into the interior of the case to be substantially surrounded by the clothes in the garment bag configuration when the case is in the closed position.

* * * * *